United States Patent [19]

Walmer

[11] 3,996,693

[45] Dec. 14, 1976

[54] DOLL HOUSE INCLUDING DECORATIVE COLUMNS

[76] Inventor: Harry E. Walmer, 721 N. Overlook Drive, Alexandria, Va. 22305

[22] Filed: Sept. 23, 1975

[21] Appl. No.: 615,895

[52] U.S. Cl. ..... 46/19

[51] Int. Cl.[2] ..... A63H 3/52

[58] Field of Search ..... 46/18, 19, 20, 21, 12, 46/13

[56] References Cited

UNITED STATES PATENTS

| | | | |
|---|---|---|---|
| 1,316,690 | 9/1919 | Crosby et al. | 46/19 |
| 2,024,899 | 12/1935 | Westveer | 46/19 |
| 2,422,217 | 6/1947 | Barnes | 46/19 |
| 2,682,727 | 7/1954 | Keljik | 46/19 X |
| 3,020,601 | 2/1962 | Stambaugh et al. | 46/19 X |
| 3,906,659 | 9/1975 | Walmer | 46/19 |

FOREIGN PATENTS OR APPLICATIONS

| | | | |
|---|---|---|---|
| 21,684 | 10/1905 | Austria | 46/19 |
| 613,767 | 12/1948 | United Kingdom | 46/19 |
| 657,171 | 9/1951 | United Kingdom | 46/19 |

*Primary Examiner*—F. Barry Shay
*Attorney, Agent, or Firm*—M. Ted Raptes

[57] ABSTRACT

The invention relates to a doll house having columns in the front, e.g., a doll house typifying Mount Vernon, George Washington's home. The doll house is of the collapsible type having a novel design in its construction. It is constructed of a small number of individual panels which comprise the walls, floors, roof, etc. The panels are provided with grooves and slots so that all the panels slide together easily and support one another. No tools or screws are required for construction and the parts are locked tightly together in a rigid structure by the simple insertion of several small pegs in matching holes provided in the various panels. The doll house has a series of decorative columns and fence on the front of the house and a unique assembly thereof is disclosed.

12 Claims, 17 Drawing Figures

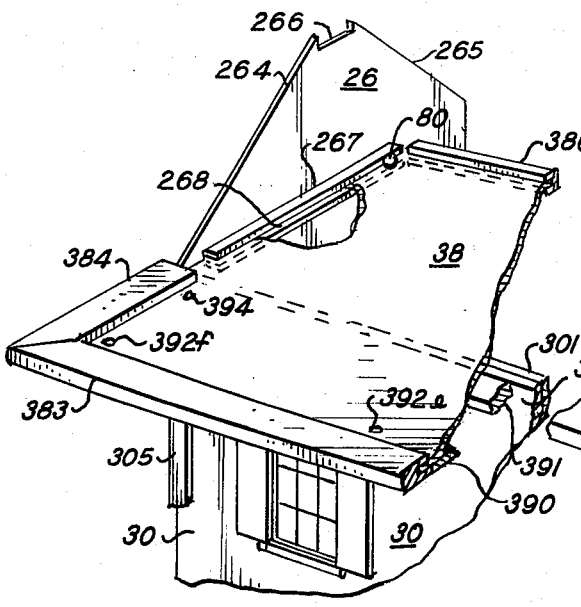
FIG. 5
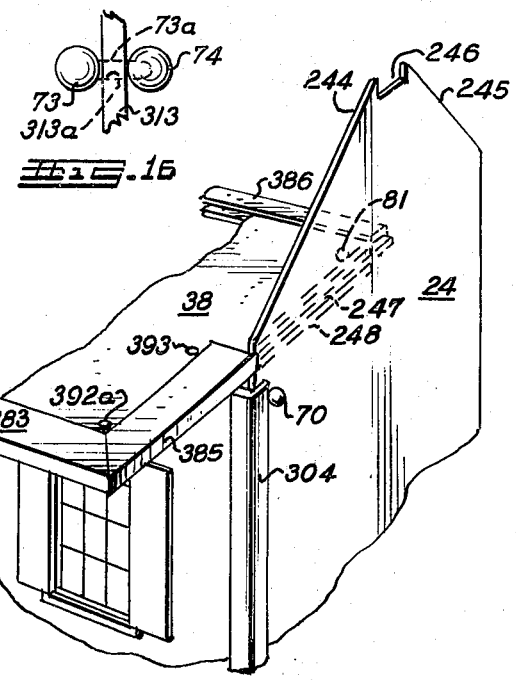
FIG. 1b
FIG. 6
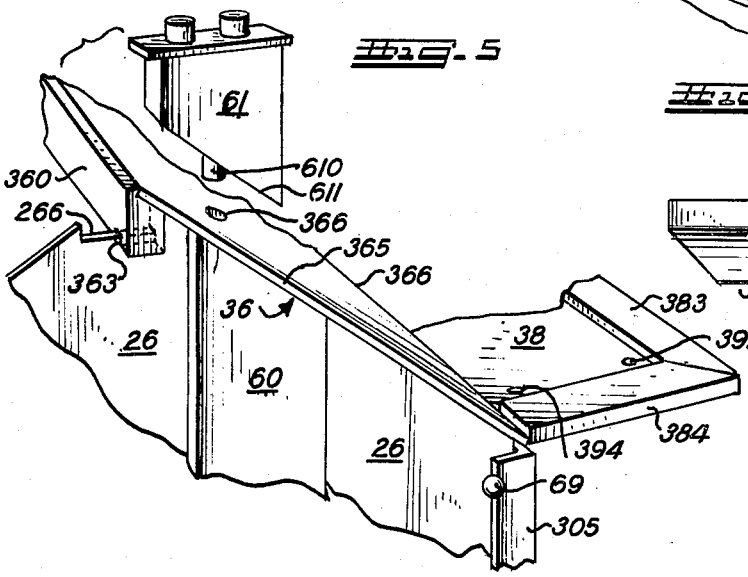
FIG. 7
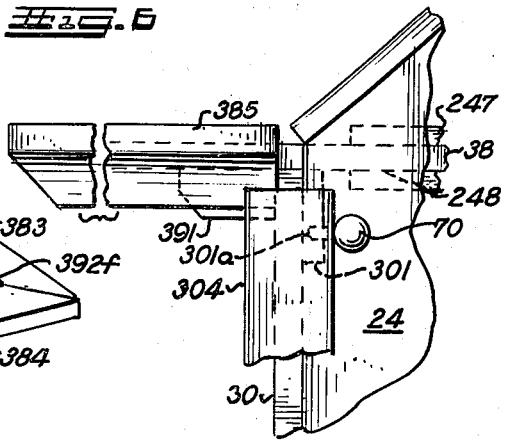
FIG. 8
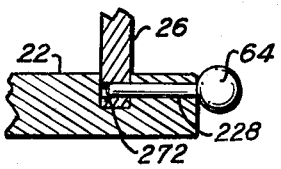
FIG. 9
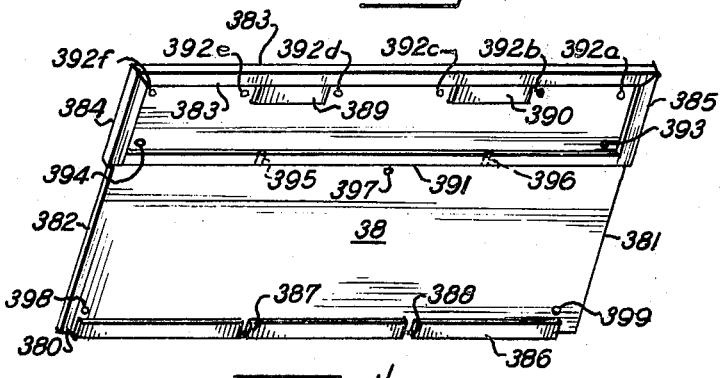
FIG. 4

DOLL HOUSE INCLUDING DECORATIVE COLUMNS

BACKGROUND OF THE INVENTION

This invention relates to a doll house or toy house of the knock-down or collapsible type having a pleasing columnar design and simplified construction, capable of being easily constructed or taken apart.

There have been developed various types of doll houses to provide recreation and education to children and adults. Many of these doll houses are of the permanent type presenting problems with respect to shipping and storage. Others, which are of the knock-down type are relatively complicated in construction and require various types of fasteners and locking members to hold the doll house together. These doll houses, for the most part require tools and screws for construction and lack the desired rigidity when constructed. Furthermore, more sturdy types of doll houses, which can be easily knocked-down, are desired by various adult hobbyists. These doll houses are required to have open access to the various floors in order that the hobbyists can set up various furniture arrangements, etc. Interior decorators also find the doll houses useful in planning the furniture arrangements, etc. of rooms. In particular, a doll house having columns has not been easy heretofore to construct in a knock-down type.

BRIEF SUMMARY OF THE INVENTION

Generally, the present invention provides a unique columnar design style of a knock-down construction for a doll house. The doll house is constructed with a unique root design and a small number of panels provided wih grooves and slots so that all parts slide together easily and support one another. Columns are provided in the front of the house which are easily assembled. The entire doll house assembles easily in minutes using no tools or screws, and once assembled, all the parts are locked tightly together to provide a rigid, sturdy structure by the simple insertion of several small pegs strategically arranged with respect to the structure of the doll house.

It is, therefore, an object of this invention to provide a doll house having a unique columnar construction design capable of being easily constructed without special skill or the use of tools and fasteners, and which can be easily disassembled or knock-down for storage or transport purposes.

Another object of this invention is to provide a doll house that is relatively rigid and sturdy in construction when assembled, requiring only simple pegs for holding the assembled house together.

A further object of this invention is to provide a doll house constructed from novel arrangement of panels provided with grooves and slots whereby construction or disassembly of the doll house in facilitated.

Another object of this invention is to provide a novel column construction for a doll house whereby the columns are held in place between a third floor and the first floor at the front of the doll house.

A further object of this invention is to provide a unique roof construction for the doll house.

Other objects, advantages and features of the invention will become apparent from the following detailed description of a preferred embodiment of the invention when considered with the accompanying drawings.

BRIEF DESCRIPTION OF THE DRAWINGS

FIG. 4 is a perspective view of the third floor member of the doll house as seen from the front and bottom disclosing details thereof;

FIG. 5 is an enlarged perspective fragmentary view, with the roof removed, as seen from the front, of the front wall, right side wall, and third floor of the doll house disclosing details of the assembly thereof;

FIG. 6 is an enlarged perspective fragmentary view, with the roof removed, as seen from the front, of the front wall, left side wall, and third floor of the doll house disclosing details of the assembly thereof;

FIG. 7 is an enlarged perspective fragmentary view as seen from the right side, of the right side wall, front roof and chimney, and third floor disclosing details of the assembly thereof;

FIG. 8 is an enlarged fragmentary side elevational view of the left front corner and front section of the third floor of the doll house disclosing details of the assembly thereof;

FIG. 9 is an enlarged fragmentary rear sectional view of the assembled right side wall and first floor disclosing details of how they are held together by a peg;

FIG. 16 is an enlarged fragmentary edge view of the door shown in FIG. 15 disclosing details of the door knobs.

DETAILED DESCRIPTION OF THE INVENTION

Figure 1:
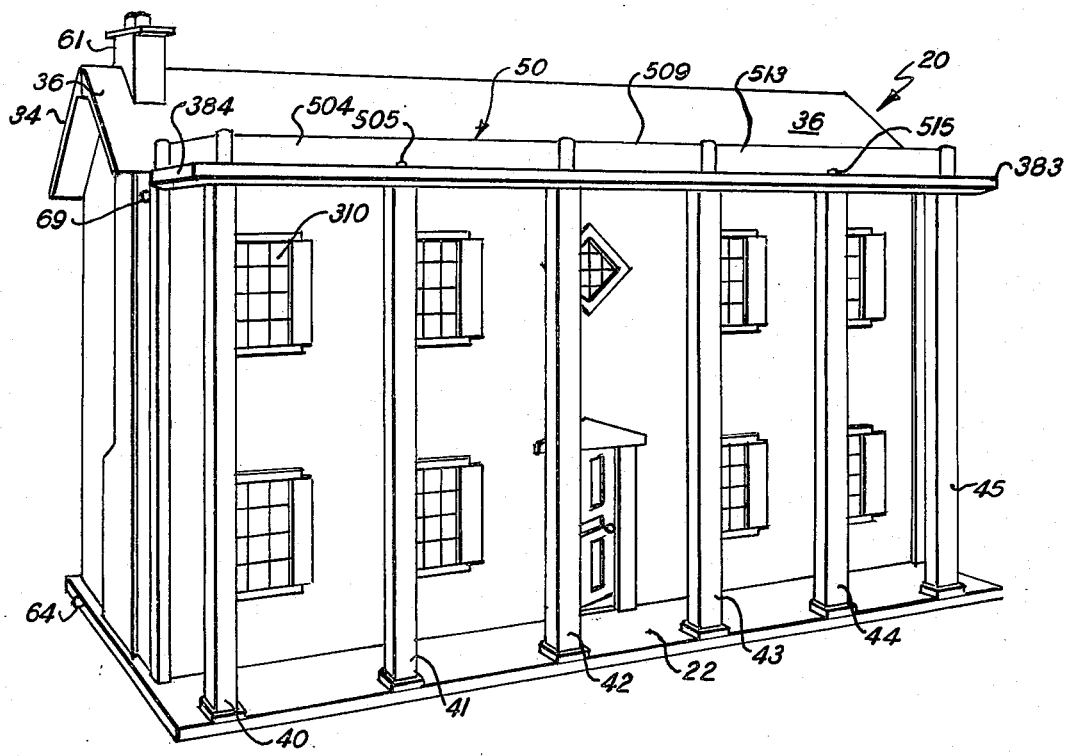
FIG. 1 is a perspective view of the front of the doll house as fully assembled embodying the novel aspects of the invention.
Figure 2:
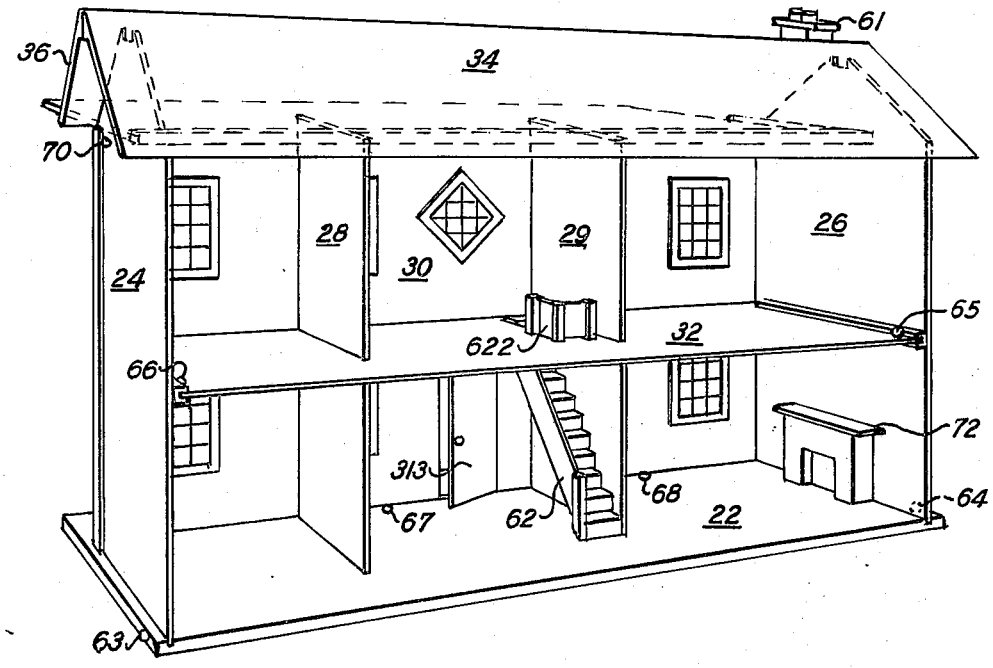
FIG. 2 is a perspective view of the rear of the doll house fully assembled disclosing the interior rooms thereof.
Figure 3:
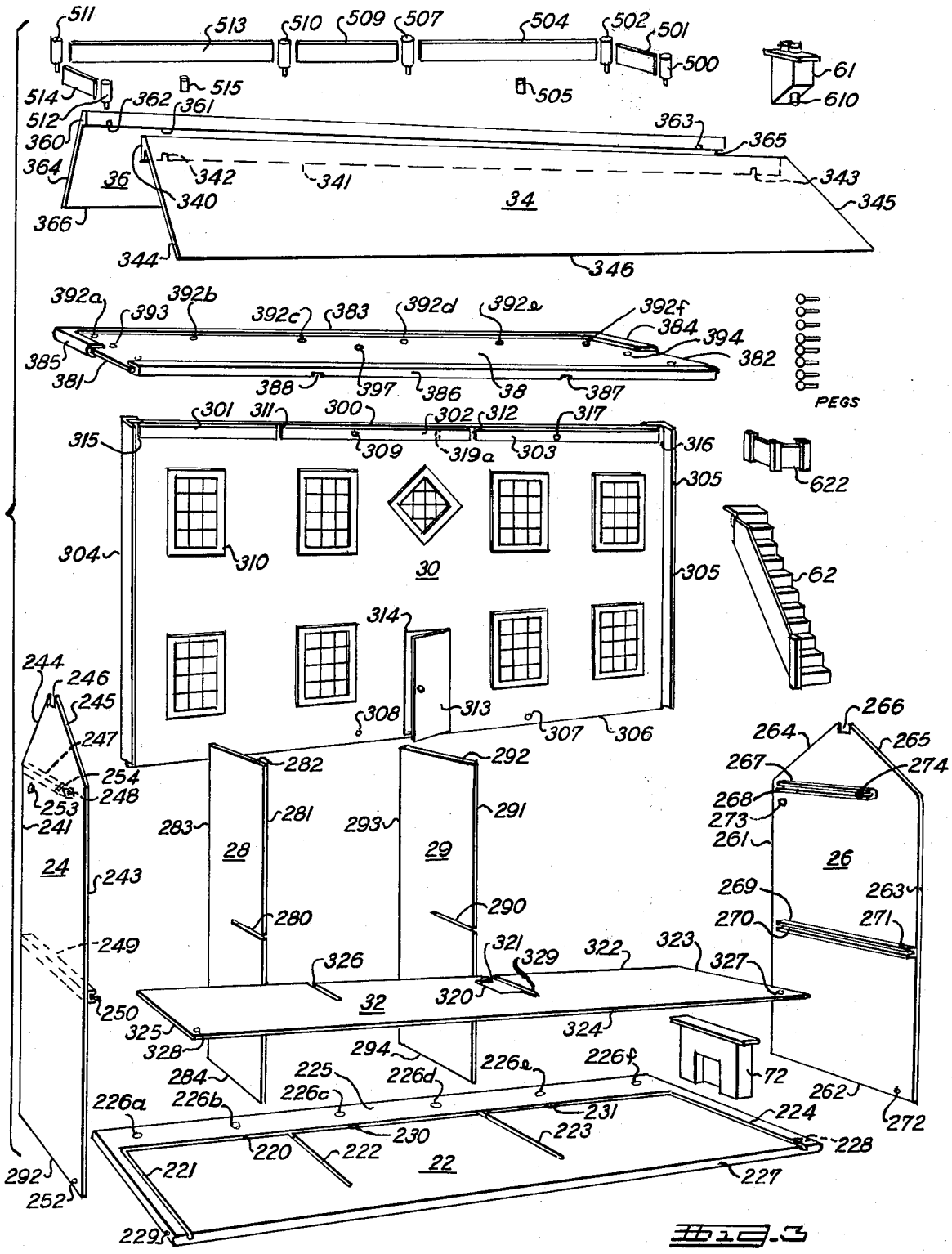
FIG. 3 is an exploded perspective rear view as seen from the rear as in FIG. 2 disclosing front, left and right side walls as well as the floors, roof, and various parts of the doll house.

Referring to the drawings, FIG. 1 shows a perspective front view of a doll house embodying the principles of the invention and FIG. 2 shows a perspective rear view of the doll house. Both views show the doll house fully assembled and ready for use as a recreational device or as a model house for display purposes with furniture arrangements, etc. FIG. 3 is an exploded perspective rear view disclosing the manner in which the various parts are assembled together.

The doll house comprises a rectangular base or first floor member 22 havng grooves 220, 221, 222, 223 and 224 in the top surface, front portion 225 containing holes 226*a–f*, and rear edge 227. A left side wall member 24 comprises bottom edge 292, front edge 241, rear edge 243, an integral second floor horizontal beam member 249 containing a groove 250, and an integral third floor horizontal beam member 247 with groove 248. The top portion of the left wall comprises slanted edges 244 and 245 with a slot 246 at the top. Similarly, a right side wall member 26 comprises bottom edge 262, front edge 261, rear edge 263, second floor horizontal beam member 269 with groove 270, integral third floor horizontal beam member 267 with groove 268, and slanted edges 264 and 265 with slot 266.

A front wall member 30 comprises top edge 300, bottom edge 306 and integral, L-shaped left and right corner beam members 304 and 305. Across the top of the inside of the front wall edge 300 horizontal beam portions 301, 302 and 303 are disposed making up a beam member with slots 315, 311, 312 and 316 disposed between the beam portions and the corner beam members 304 and 305. Windows 310, doorway 314 and door 313 are also disposed in the front wall member.

An intermediate wall member 28 comprises front edge 283, rear edge 281, bottom edge 284, top edge 282, and horizontal slot 280. Similarly, a second intermediate wall member 29 comprises edges 293, 291, 294 and 292, respectively, and slot 290.

A second floor member 32 comprises front edge 322, rear edge 324, left and right side edges 325 and 323, stair well 320 having open end 321 and slot 329, and slot 326.

A third floor member 38, (see FIGS. 3 and 4) comprises a rear edge 380 and left and right side edges 381 and 382. A rear horizontal beam 386, containing slots 387 and 388 on the underside, is integral with rear edge 380 but does not extend to side edges 381 and 382. A front horizontal beam member 383 forms a mitered edge with left and right side horizontal beam members 385 and 384 disposed integrally on the forward part of edges 381 and 382 respectively. A horizontal beam 391 is disposed on the bottom of floor 38 and extends between beams 384 and 385. A pair of spacer members 389 and 390 are disposed on the underside of floor 38 adjacent to beam 383 and between holes 392*e*, *d* and holes 392*b*, *c*, respectively. Beams 383, 384, 385 and spacers 389, 390 are adapted to provide aligning means for predrilling and aligning holes 400, 410, 420, 430, 440, and 450 in columns 40–45 with respective holes 392, *a*, *b*, *c*, *d*, *e*, and *f*, of floor 38 as will be described more fully hereinafter.

A rear roof member 34 comprises bottom edge 346, left and right side edges 344 and 345, and a top beam member 340 with edge 341 having slots 342 and 343. A similar front roof member 36 comprises bottom edge 366, left and right side edges 364 and 365, and a top beam member 360 with edge 361 having slots 362 and 363.

A decorative fence 50 is adapted to be disposed on the top of the forward portion of the overhanging third floor 38, and comprises posts and braces 500, 502, 507, 510, 511 and 512 as well as fence sections 501, 504, 509, 513 and 514. A chimney 61 is adapted to be secured in the top of front roof 36. As in FIG. 1, a series of decorative columns 40–45 are adapted to be disposed in the outside front of the doll house between the overhang of the third floor and the first floor. A staircase 62 with guard rail 622 as well as a fireplace 72 are adapted to be disposed in the doll house.

Figure 15:
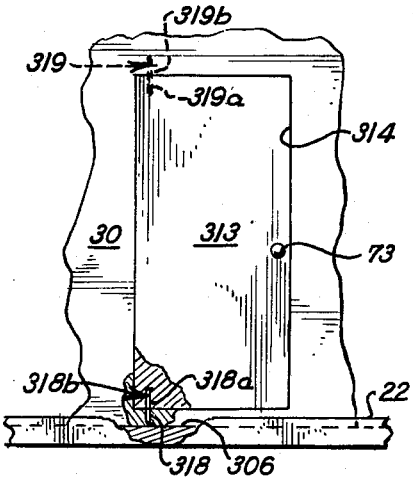
FIG. 15 is an enlarged front plan view of the door assembly on the first floor.

In FIG. 15, a novel means for installing a door 313 in a doorway 314 on the first floor of the front wall 30 is provided. The door 313 has an upwardly extending pin 319 initially inserted in hole 319*a*. The door is angled into the top of the doorway and the end of pin 319 marks a point on the underside of the top of the doorway where a hole 319*b* is drilled after the door is removed. Pin 319 is removed from hole 319*a* and is inserted in hole 319*b* with a portion of pin 319 being exposed. The door 313 is then fitted into the doorway 314 with the door and hole 319*a* angled into the exposed pin 319 until the door is mounted flush in the doorway. Two holes 318 in wall 30 and 318*a* in door 313 are drilled simultaneously up through the bottom edge 306 of wall 30. Pin 318*b* is inserted first in hole 318 and then hole 318*a* to secure the door in the doorway. This procedure assures alignment of the holes and flushness of the door in the doorway.

Figure 10:
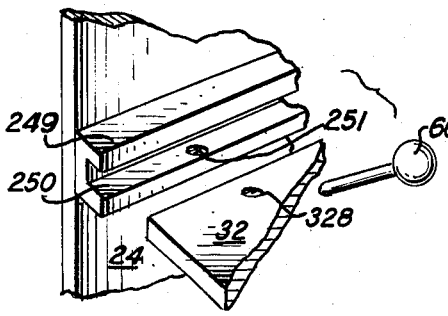
FIG. 10 is an enlarged fragmentary perspective view of the left side wall and second floor disclosing details of the assembly thereof.
Figure 11:
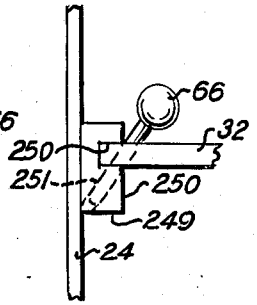
FIG. 11 is an enlarged fragmentary rear plan view of the assembled left side wall and second floor disclosing details of how they are held together by a peg.

Intermediate walls 28 and 29 are next inserted in grooves 222 and 223 of floor 22, and also the front edges 283 and 293 of each are inserted in slots 311 and 312, respectively, of front wall 30. Second floor 32 is next assembled by sliding left and right side edges 325 and 323 simultaneously in grooves 250 and 270 of the side walls 24 and 26, respectively. The second floor is pushed forward until its front edge 322 abuts against wall 30 and, in so doing, slots 326 and 280 are engaged as well as slots 329 and 290. The second floor and intermediate walls are retained in place by inserting peg 66 in hole 328 of the second floor and hole 251 in beam 250 of the left side wall (see FIGS. 10 and 11), and, similarly peg 65 is inserted in hole 327 of the second floor and hole 271 in beam 270 of the right side wall.

Figure 12:
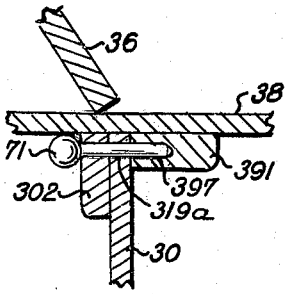
FIG. 12 is an enlarged fragmentary side sectional view through the center of the front wall of the asembled front roof, third floor, and front wall showing how they are held together by a peg.

The third floor 38 is next assembled by inserting, from the front of the doll house, edges 381 and 382 into grooves 248 and 268, respectively, of the two side walls. At the same time, slots 388 and 387 of the floor beam 386 engage the top edges 282 and 292 of intermediate walls 28 and 29, respectively. The third floor is pushed towards the rear of the house until beam 391 abuts the top of front wall 30 (see FIGS. 5 and 6). The third floor is retained in place by inserting a peg (not shown) in hole 309 of beam 302 of wall 30 and hole 396 of beam 391 of the third floor. Similarly, another peg (not shown) is inserted in holes 317 and 395. Another peg 71 is inserted from the front in hole 319*a* of front wall 30 and hole 397 in the beam 391 of third floor 38 (see FIGS. 1 and 12). Peg 80 is inserted in hole 398 of the third floor and hole 274 of beam 267 of wall 26, and similarly peg 81 is inserted in holes 399 and 254.

The rear roof member 34 is installed by inserting the slots 342 and 343 of edge 341 of the beam 340 in slots 246 and 266 of the left and right side walls, respectively. The inner surface of the roof rests on the rear slanted edges 245 and 265 of the left and right side walls, respectively. Similarly, the slots 362 and 363 of the front roof beam 361 are installed in slots 246 and 266, and the roof member 36 rests on front slanted edges 244 and 264 of the left and right side walls, respectively. The chimney 61 is installed in roof 36 by inserting peg 610 of the bottom slanted surface 611 in hole 366 of the roof.

BEST AVAILABLE COPY

Figure 13:
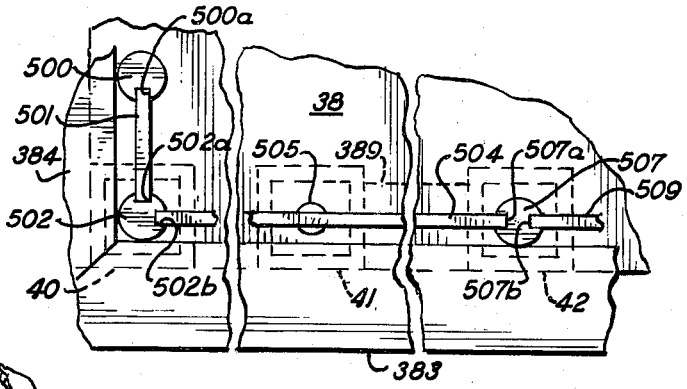
FIG. 13 is an enlarged fragmentary top view of the right front overhang of the third floor disclosing details of the assembly of the columns and fence.
Figure 14:
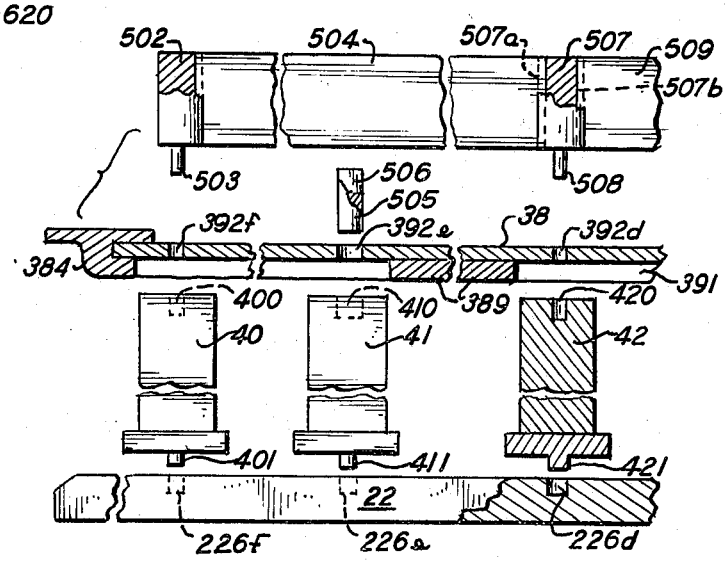
FIG. 14 is a side exploded view of the parts shown in FIG. 13 and additional details of the assembly of the columns and fence.

The front columns 40–45 are installed and retained in place in conjunction with the decorative fence 50 (see FIGS. 13 and 14). Column 40 comprises a bottom center peg 401 and a hole 400 in the center of the top. Column 40 is placed in position by inserting peg 401 in hole 226*f* of floor 22 and the top of the column is abutted against the inside underneath corner of beams 383 and 384. Holes 400 and 392*f* are predrilled simultaneously, thereby assuring alignment of the two holes when the column is abutted to beams 383 and 384. Post 502 of the decorative fence comprises peg 503, which is inserted in aligned holes 392*f* and 400 to retain column 40 in place. Similarly, column 45 is installed using post 511 and holes 226*a* and 392*a*. This type of installation prevents the columns from undesirable rotation.

Column 42 comprises a bottom center peg 421 and top center hole 420. Column 42 is placed in position by inserting peg 421 in hole 226*d* of floor 22 and the top of the column is abutted against the underneath corner formed by spacer member 389 and beam 383 whereby predrilled holes 420 and 392*d* are aligned. Peg 508 of post 507 is inserted in aligned holes 392*d* and 420 to retain column 42 in place. Similarly, column 43 is installed against spacer member 390 using post 510 and aligned holes 226*c* and 392*c*.

Column 41 comprises a bottom center peg 411 and center hole 410 in the top and is placed in position by inserting peg 411 in hole 226*e* of floor 22 and the top is abutted against the underneath corner formed by spacer member 389 and beam 383, whereby predrilled holes 410 and 392*e* are aligned. A fence brace 505 is inserted in aligned holes 392*e* and 410 to retain column 41 in place. Similarly, column 44 is installed against horizontal member 390 using fence brace 515 and aligned predrilled holes 392*b* and 226*b*.

The decorative fence 50 is installed on the top of the overhang of the third floor and involves securing the fence members with the fence posts and braces already installed to retain the columns. Fence post 507 comprises vertical slots 507*a* and 507*b* on both sides. Post 510 is similar in construction. Fence 509 is installed between the two posts 507 and 510 in the respective vertical slots. Post 502 comprises vertical slots 502*a* and 502*b* disposed 90° to each other. Fence brace 505 comprises horizontal slot 506. Fence 504 is installed between the two posts 502 and 507 in the respective vertical slots and also in the slot 506 of brace 505. Post 511 is the same as post 502 and fence brace 515 is the same as brace 505. Fence 513 is installed between the two posts 510 and 511 in the respective vertical slots an also in horizontal slot of brace 515. The side fence 501 is installed in vertical slot 502*a* of post 502 and in vertical slot 500*a* of post 500. Post 500 is inserted in hole 394 of floor 38. Similarly, fence 514 is installed between post 511 and post 512, which is inserted in hole 393.

The placement of the pegs for holding the doll house together is iniquely designed for easy assembly as well as providing the rigidity required for the doll house. For the most part, a triangular arrangement is provided for the pegs. Thus, pegs 69, 70 and 66; pegs 69, 70 and 63; pegs 65, 66 and 71; 63, 64 and 71, etc., all form a triangular construction.

Figure 17:
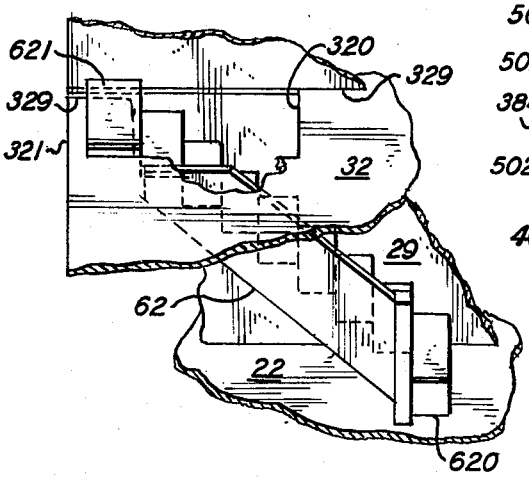
FIG. 17 is an enlarged fragmentary perspective view of the assembled staircase between the first and second floor members.

As shown in FIGS. 2 and 17 a unitary staircase 62 is installed between the first and second floors against intermediate wall 29. The bottom 620 of the staircase rests on the first floor 22 and an upper edge 621 extends through the stair well 320 and rests on ledge 321. A protective L-shaped handrail 622 is also provided around the stair well.

A decorative unitary fireplace 72 is placed along the inner wall of the right side wall 26 on the first floor. The fireplace aligns with the simulated chimney 60 on the outer wall of side wall 26 and chimney 61 on the roof (see FIG. 7).

In FIG. 15, a novel means for installing a door 313 in a doorway 314 on the first floor of a front wall 30 is provided. The door 313 has an upwardly extending pin 319 initially inserted in hole 319*a*. The door is angled into the top of the doorway and the end of pin 319 marks a point on the underside of the top of the doorway where a hole 319*b* is drilled after the door is removed. Pin 319 is removed from hole 319*a* and inserted in hole 319*b* with a portion of pin 319 being exposed. Two holes 318 is wall 30 and 318*a* in door 313 are drilled simultaneously up through the bottom edge 306 of wall 30. Pin 318*b* is inserted first a hole 318 and then hole 318*a* to secure the door in the doorway. This procedure assures alignment of the holes and flushness of the door in the doorway.

As shown in FIG. 16, a novel knob construction for the door is shown. Peg 73 has pin 73*a* which extends through hole 313*a* of the door. A peg knob 74 is inserted on the end of pin 73*a* which protrudes through the hole of the door.

The doll house is knocked-down or disassembled by reversing the above procedure. The unique and novel design provides the benefits of knock-down construction. The use of grooves and slots provide means for easily sliding the various parts together, which support one another. The doll house is rigid in construction and all parts are held together tightly by the simple insertion of a relatively small member of strategically arranged small pegs. When disassembled, the parts of the doll house can be stacked together for easy storage or shipment.

Although the doll house of this invention has been disclosed heretofore as the preferred embodiment, wherein six rooms are available by using the two intermediate wall members 28 and 29, it is understood that the doll house can be constructed to contain more than two intermediate wall members thus providing eight or more rooms. It is also contemplated within the invention that only one intermediate wall member can be used to provide the doll house with four rooms. Futhermore, the number of columns used can be more or less than six as shown in the preferred embodiment.

The above description of the invention is deemed to be the most practical and efficient embodiment and it should be understood that the invention is not limited to such embodiments as heretofore indicated as there could be further changes made in the arrangement, disposition and form of the parts without departing from the principle of the present invention within the scope of the accompanying claims.

What is claimed is:

1. An easily assembled knock-down doll house having a columnar design, the parts of which are fitted together and held together only with pegs comprising:

a. a generally rectangular first floor member comprising left, right, and front grooves in the top surface thereof, at least one intermediate groove parallel to said left and right grooves, and a series of in-line holes disposed forward of said front groove;

b. a front wall member having a size and shape adapting it to have its bottom edge engage said front

BEST AVAILABLE COPY groove of said first floor member, comprising vertical L-shaped side beams and a top horizontal beam member disposed on the inner front wall containing at least one vertical slot;

c. left and right side walls having respective sizes and shaped adapting them to have their front edges engage said L-shaped beams of said front wall and their bottom edges engage said respective left and right grooves of said first floor, each of said side walls containing a top, inner horizontal beam member having an inward side groove, an inner second-horizontal beam member having an inward side groove and disposed between said side wall top beam and the lower edge of said side wall, inwardly angled top edges, an a slot disposed at the terminus of said angled top edges;

d. at least one intermediate wall member adapted to have its lower edge engage a respective said intermediate groove in said first floor and a said vertical slot of said front wall top beam member, comprising an intermediate horizontal slot extending forwardly from the rear edge;

e. a second floor member adapted to have its side edges engage said grooves of said inner second beam members of said side walls and comprising a stairwell near the front edge portion thereof containing an opening to said front edge and at least one horizontal slot extending rearwardly from the front edge, said slot adapted to engage said horizontal slot of said intermediate wall member;

f. a third floor member adapted to have a portion of its side edges engage said grooves of said top beam member of said side walls, and comprising parallel horizontal front, rear and intermediate beam members, side beam members disposed between said front and intermediate beam members, at least one slot disposed on the underside of said rear beam members adapted to engage the top edge of a said intermediate wall member, and a series of in-line holes disposed through and along the front portion of said third floor member;

g. front and rear roof panels each comprising a horizontal beam member disposed along the underportion of one edge containing a slot near each end, said panels being constructed and arranged to adapt said roof beams to enter said terminus slots of said side walls and to adapt the slots of said beams to receive the edge of said terminus slots with said respective roof beams disposed adjacent to each other and said panels disposed along said angled edges of said side walls;

h. said third floor member which comprises said series of holes and front rear and intermediate beam members, and said front section of said first floor member which comprises said series of holes both having a size and shape adapting them to extend beyond the front of said front wall member;

i. a series of vertical columns having respective sizes and shapes adapting them to be disposed between said front portion of said third floor and said first floor with each column having its bottom portion disposed in one of said first floor series of holes and its top portion retained by peg means disposed through one of said third floor series of holes, and peg means for so retaining said columns;

j. a plurality of pegs adapted to be inserted in holes contained in said beams, grooves, wall and floor members at their junctures with each other for retaining said assembled structure together.

2. The doll house of claim 1 including a fence having a size and shape adapting it to be disposed on the top surface of said front section of said third floor member, and wherein said pegs retaining said columns comprise post and slot means adapted to receive and retain sections of said fence.

3. The doll house of claim 1 wherein said top portion of each of said columns has a hole which has been predrilled simultaneously with a mating hole of said third series of holes.

4. The doll house of claim 3 wherein the top sections of said columns are adapted to be positioned against the underside of said third floor and abut said front beam member to enable alignment of said mating holes.

5. The doll house of claim 4 wherein the intermediate columns of said columns are adapted to also abut spacer members to enable alignment of said mating holes.

6. The doll house of claim 4 wherein the end columns of said columns are adaptable to also abut said side beam members to enable alignment of said mating holes.

7. The doll house of claim 1 including two intermediate wall members having respective sizes and shapes adapting them to be disposed between said side walls.

8. The doll house of claim 1 wherein said third floor is adapted to be inserted into said grooves of said top horizontal beam of said side wall members from the front of the doll house and said intermediate horizontal beam member of said third floor abuts the front wall thereof.

9. The doll house of claim 1 wherein said right side wall has a fireplace adapted to be removably disposed on its inner wall and a simulated chimney on its outer wall extending to a chimney adapted to be removably disposed in said front roof panel.

10. The doll house of claim 1 wherein a staircase is adapted to be removably disposed between said first and second floor members in a stairwell.

11. In an easily assembled knock-down type of doll house comprising a series of decorative columns disposed vertically across the front of the house, front wall means, side wall means, first floor means having a forward section extending beyond the front of said front wall means, and roof member means, wherein all said means are retained together as an assembled structure by pegs inserted in peg holes contained in said floor and wall means at their junctures, the provision of upper floor means for retaining said columns on said forward section of said first floor means, comprising an upper floor member, said wall means including means for retaining said upper floor member whereby said upper floor member is adapted to be inserted from and into the front of said doll house and retained in place parallel to said first floor means and between said side walls, each of said columns comprising bottom peg means and top hole means, said upper floor member comprising a forward section extending beyond the front of said front wall means, said forward section of said first floor means including a series of hole means wherein said bottom peg means of said columns can be inserted, said upper floor front section comprising a series of predrilled hole means adapted to be aligned with said hole means in the tops of said columns, fastening means adapted to be inserted in said respective hole means of said columns and said upper floor forward section.

12. The upper floor member of claim 11 wherein aligning means are provided in said upper floor forward section for aligning said respective holes of said columns and said holes of said upper floor forward member during installation of said columns.

* * * * *